US007941067B2

(12) United States Patent
Thayer et al.

(10) Patent No.: US 7,941,067 B2
(45) Date of Patent: May 10, 2011

(54) APPARATUS FOR PRINT ASSEMBLY BLADE DEFLECTION DETECTION

(75) Inventors: Bruce Earl Thayer, Webster, NY (US); Aaron Michael Burry, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 399 days.

(21) Appl. No.: 12/259,535

(22) Filed: Oct. 28, 2008

(65) Prior Publication Data

US 2010/0104310 A1 Apr. 29, 2010

(51) Int. Cl.

| | |
|---|---|
| ***G03G 13/09*** | (2006.01) |
| ***G03G 13/11*** | (2006.01) |
| ***G03G 21/00*** | (2006.01) |
| ***G03G 21/10*** | (2006.01) |

(52) U.S. Cl. ..... 399/71; 399/350; 399/345; 399/123; 399/264; 399/273; 399/327

(58) Field of Classification Search ..... 399/71
See application file for complete search history.

(56) References Cited

U.S. PATENT DOCUMENTS

| | | | | |
|---|---|---|---|---|
| 4,937,633 | A * | 6/1990 | Ewing | 399/34 |
| 5,264,904 | A | 11/1993 | Audi et al. | |
| 5,278,620 | A * | 1/1994 | Godlove | 399/71 |
| 5,799,226 | A * | 8/1998 | Shigeta et al. | 399/66 |
| 2008/0232874 | A1 | 9/2008 | Parks et al. | |

* cited by examiner

*Primary Examiner* — David M Gray
*Assistant Examiner* — David Bolduc
(74) *Attorney, Agent, or Firm* — Matthew C. Loppnow; Prass LLP

(57) ABSTRACT

An apparatus (100) that detects blade deflection from a print assembly contact surface is disclosed. The apparatus can include a print assembly (110) rotationally supported in the apparatus, where the print assembly can have a print assembly contact surface (112) and a print assembly conductor (114). The apparatus can include a blade (120) configured to be coupled to the print assembly contact surface and a blade conductive layer (130) coupled to the blade. The apparatus can include a sensor (140) configured to measure a capacitance between the blade conductive layer and the print assembly conductor.

20 Claims, 5 Drawing Sheets

APPARATUS FOR PRINT ASSEMBLY BLADE DEFLECTION DETECTION

BACKGROUND

Disclosed herein is an apparatus that detects blade deflection from a print assembly contact surface.

Presently, printing systems use rotationally supported print assemblies to produce prints on media. Such rotationally supported print assemblies can include photoreceptor belts, photoreceptor rolls, development rolls, fusers, release fluid transfer rolls, release fluid transfer belts, ink jet printer print drums, ink jet printer print belts, and other rotationally supported print assemblies. The printing systems can also use blades to clean, meter, triboelectrically charge, or otherwise manipulate the print assembly contact surfaces and/or the materials on them For example, the blade can affect toner, oil, or other material that is on the contact surface. Alignment of the blades to the contact surface is important to create a uniform contact and blade load along the length of the blade. Blade load is created by either directly applying a force to a pivoted blade holder or by positioning the blade holder relative to the contact surface to create an interference with the blade.

Conventional blade designs control critical parameters, such as blade alignment, blade interference, and other parameters, by either very tight control of component dimensional tolerances or during a manufacturing set-up. Either method adds cost to the blade assembly. New blade systems can use adjustable interference actuators and can have the capability of automatically installing replacement blades. Unfortunately, these systems also require high component tolerances to accurately locate blades against the contact surface. Thus, there is a need for a low cost, accurate, and efficient method of aligning a blade to a contact surface at the desired blade load.

SUMMARY

An apparatus that detects blade deflection from a print assembly contact surface is disclosed. The apparatus can provide for a low cost, accurate, and efficient method of aligning a blade to a contact surface at a desired blade load. The apparatus can include a print assembly rotationally supported in the apparatus, where the print assembly can have a print assembly contact surface and a print assembly conductor. The apparatus can include a blade configured to be coupled to the print assembly contact surface and a blade conductive layer coupled to the blade. The apparatus can include a sensor configured to measure a capacitance between the blade conductive layer and the print assembly conductor.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

The embodiments include an apparatus for detecting blade deflection from a print assembly contact surface. The apparatus can include a print assembly rotationally supported in the apparatus, where the print assembly can have a print assembly contact surface and a print assembly conductor. The apparatus can include a blade configured to be coupled to the print assembly contact surface and a blade conductive layer coupled to the blade. The apparatus can include a sensor configured to measure a capacitance between the blade conductive layer and the print assembly conductor.

The embodiments further include an apparatus for detecting blade deflection from a print assembly contact surface. The apparatus can include a print assembly rotationally supported in the apparatus, where the print assembly can have a print assembly contact surface and the print assembly can have a print assembly conductor having a known voltage reference. The apparatus can include a blade moveably supported in the apparatus, where the blade can be configured to be coupled to the print assembly contact surface and the blade can be configured to manipulate material on the print assembly contact surface. The apparatus can include a blade conductive layer coupled to the blade and a blade deflection sensor configured to measure a capacitance between the blade conductive layer and the print assembly conductor.

The embodiments further include an apparatus for detecting blade deflection from a print assembly contact surface. The apparatus can include a print assembly rotationally supported in the apparatus, where the print assembly can have a print assembly contact surface and the print assembly can have a print assembly conductor having a known voltage reference. The apparatus can include a blade moveably supported in the apparatus, where the blade can be configured to be coupled to the print assembly contact surface and the blade can be configured to manipulate material on the print assembly contact surface. The apparatus can include a blade conductive layer coupled to the blade and a blade deflection sensor configured to measure a capacitance between the blade conductive layer and the print assembly conductor by providing a signal to the blade conductive layer and receive a signal from the blade conductive layer, where the received signal can correspond to a capacitance between the blade conductive layer and the print assembly conductor. The apparatus can include a controller configured to adjust a blade position relative to the print assembly contact surface based on the measured capacitance to achieve a desired blade load.

Figure 1:
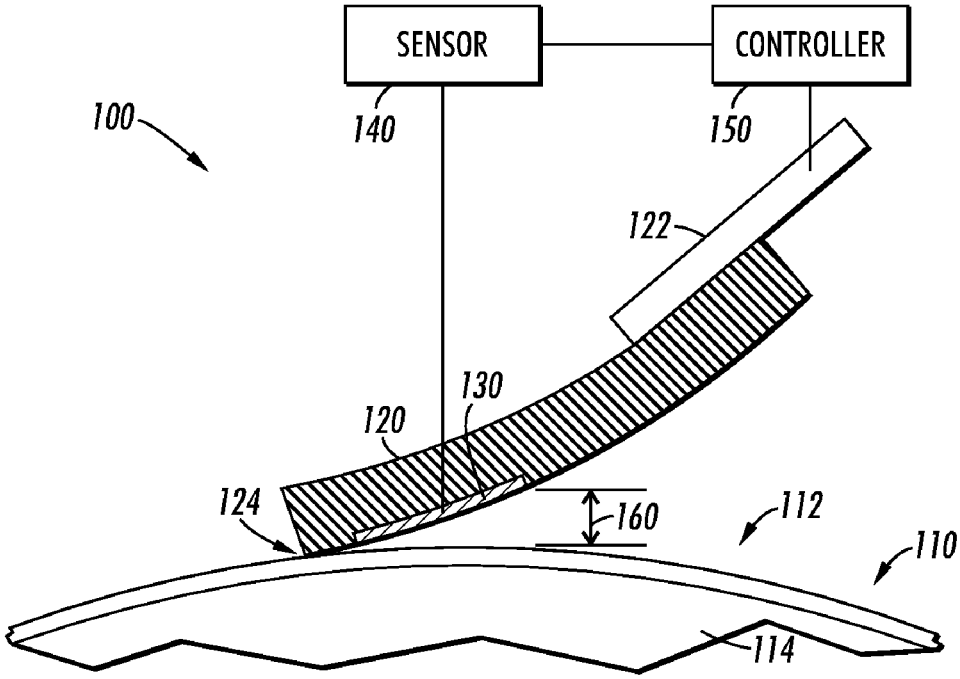
FIG. 1 is an exemplary illustration of an apparatus.

FIG. 1 is an exemplary illustration of an apparatus 100. The apparatus 100 may be a printer, a multifunction media device, a xerographic machine, or any other device that produces an image on media. The apparatus 100 can include a print assembly 110 rotationally supported in the apparatus 100, where the print assembly 110 can have a print assembly contact surface 112 and the print assembly 110 can have a print assembly conductor 114. The print assembly contact surface 112 can be a photoreceptor belt contact surface, a photoreceptor roll contact surface, a development roll contact surface, a fuser contact surface, a release fluid transfer roll contact surface, a release fluid transfer belt contact surface, an ink jet printer print drum contact surface, an ink jet printer print belt contact surface, or any other print assembly contact surface. The print assembly conductor 114 can be a conductive reference plane relative to the print assembly contact surface 112, such as a ground plane, a shaft, a metal bar, or any other conductor coupled to the print assembly contact surface 112 or the print assembly conductor 114 can be part of or integrated into the print assembly contact surface 112. The print assembly conductor 114 can have a known voltage reference, such as a ground reference, a reference plane, or other voltage reference.

The apparatus 100 can include a blade 120 configured to be coupled to the print assembly contact surface 112. The blade 120 can be mounted on a blade mount or holder 122. The blade 120 can be a blade useful for cleaning, metering, or triboelectrically charging the print assembly contact surface 112. For example, the blade 120 can be a print assembly cleaning blade for cleaning a print assembly contact surface, the blade 120 can be an oil metering blade for metering oil on a print roll or belt surface, the blade 120 can be a development charging blade in a single component xerographic system, or the blade 120 can be any other blade configured to be coupled to a print assembly contact surface.

The apparatus 100 can include a blade conductive layer 130 coupled to the blade 120. The blade conductive layer 130 can be a conductive strip, conductive tape, conductive ink, conductive paint, a conductive layer embedded in the blade 120, or any other conductive layer. For example, the blade conductive layer 130 can be conductive ink that is printed on the blade 120 when instructions, labels, part numbers, or other indicia are printed on the blade 120. The blade conductive layer 130 can also be a metal film, such as aluminum, copper, brass, stainless steel, or any conductive film that can be adhered to the blade 120 using double sided tape, glue, or any other adhesive. The blade conductive layer 130 can be positioned along a length of the blade 120. The blade conductive layer 130 can also permeate the blade 120 by being embedded in the blade 120. For example, the blade conductive layer 130 can include conductive particles added within the blade 120 or can be a conductive layer of a multi-layer laminated blade. The blade conductive layer 130 can be coupled to the blade 120 to minimize the distance between the blade conductive layer 130 and the print assembly contact surface 112 and/or the print assembly conductor 114 when the blade 120 is coupled to the print assembly contact surface 112 to maximize the capacitance between the blade conductive layer 130 and the print assembly conductor 114. For example, the blade conductive layer 130 can be mounted on a surface of the blade 120 facing the print assembly contact surface 112 and the blade conductive layer 130 can be positioned as close as possible to a tip 124 of the blade 120 in proximity with the print assembly contact surface 112 without coming in contact with the print assembly conductor 114 or the print assembly contact surface 112. This can provide the greatest sensitivity to changes in capacitance between the blade conductive layer 130 and the print assembly conductor 114. Also, the bending of the blade 120 can be greatest near the contacting tip 124. By positioning the blade conductive layer 130 near the tip 124 that contacts the print assembly contact surface 112, greater changes in capacitance can be observed when blade interference changes. The blade conductive layer 130 generally should not touch the print assembly contact surface 112 to avoid wear of the print assembly contact surface 112 and/or the blade conductive layer 130 and to avoid possible electrical shorting. The blade conductive layer 130 generally should be close enough, but not so close to the contacting tip 124 of the blade 120 that it interferes with its proper functioning.

The apparatus 100 can include a sensor 140 configured to measure a capacitance between the blade conductive layer 130 and the print assembly conductor 114. The sensor 140 can be a blade deflection sensor, an interference sensor, a capacitance sensor or any other sensor that can measure a capacitance between the blade conductive layer 130 and the print assembly conductor 114.

The apparatus 100 can include a controller 150 configured to adjust a blade 120 position relative to the print assembly contact surface 112 based on the measured capacitance. The controller 150 can be configured to identify a change in a distance between the blade conductive layer 130 and the print assembly contact surface 112 based on the measured capacitance. The controller 150 can include functions of the sensor 140 and/or the sensor 140 can include functions of the controller 150. The controller 150 or the sensor 140 can be configured to provide a signal to the blade conductive layer 130 and receive a signal from the blade conductive layer 130, where the received signal can correspond to a capacitance between the blade conductive layer 130 and the print assembly conductor 114. The controller 150 can be configured to adjust a blade 120 position relative to the print assembly contact surface 112 based on the measured capacitance to substantially achieve a desired capacitance between the print assembly conductor 114 and the blade conductive layer 130. The desired capacitance can correspond a desired blade 120 load, an angle between the blade tip 124 and the print assembly contact surface 112, a desired interference between the blade 120 and the print assembly contact surface 112, or any other desired feature that corresponds to a capacitance. The interference can be the difference between the uncontacted blade 120 without the print assembly contact surface 112 and the deflection of the blade 120 contacting the print assembly contact surface 112. For example, the interference can be how much the blade 120 is deflected from its uncontacted position normal to the print assembly contact surface 112, such as the distance between the print assembly contact surface 112 and the undeflected blade tip 124 without the print assembly contact surface 112. The controller 150 can include or can be coupled to a blade adjustment mechanism that adjusts the blade 120 position.

The blade 120 can be positioned in any orientation relative to the print assembly contact surface 112. For example, the blade 120 can be positioned as a doctor blade so that the tip 124 goes against the contact surface movement if the contact surface 112 is moving in a counterclockwise direction or positioned as a wiper blade so that the tip 124 goes with the contact surface movement if the contact surface 112 is moving in a clockwise direction. As another example, the blade 120 can be positioned at any angle relative to the contact surface 112 from a more horizontal angle to a more vertical angle than the illustrated angle. Furthermore, the conductive layer 130 can reside within the blade 120 or along any surface of the blade 120. The blade 120, the conductive layer 130, or other elements of the apparatus 100 can additionally be positioned in any other useful orientation.

According to a related embodiment, the apparatus 100 can include a print assembly 110 rotationally supported in the apparatus 100. The print assembly 110 can have a print assembly contact surface 112 and the print assembly 110 can have a print assembly conductor 114 having a known voltage reference. The apparatus 100 can include a blade 120 moveably supported in the apparatus 100. The blade 120 can be configured to be coupled to the print assembly contact surface 112 and the blade 120 can be configured to manipulate material on the print assembly contact surface 112. For example, the blade 120 can manipulate material on the print assembly contact surface 112 by cleaning the print assembly contact surface 112, by metering material on the print assembly contact surface 112, by charging the print assembly contact surface 112, by triboelectrically charging material on the print assembly contact surface 112, or by otherwise manipulating the print assembly contact surface 112. The apparatus 100 can include a blade conductive layer 130 coupled to the blade 120. The apparatus 100 can include a blade deflection sensor 140 configured to measure a capacitance between the blade conductive layer 130 and the print assembly conductor 114.

The apparatus 100 can include a controller 150. The controller 150 or the sensor 140 can be configured to provide a signal to the blade conductive layer 130 and configured to receive a signal from the blade conductive layer 130, where the received signal can correspond to a capacitance between the blade conductive layer 130 and the print assembly conductor 114. The controller 150 can also be configured to adjust a blade 120 position relative to the print assembly contact surface 112 based on the measured capacitance. The controller 150 can be configured to adjust a blade 120 position relative to the print assembly contact surface 112 based on the measured capacitance to substantially achieve a desired capacitance between the print assembly conductor 114 and the blade conductive layer 130.

According to another embodiment, the apparatus 100 can include a print assembly 110 rotationally supported in the apparatus 100. The print assembly 110 can have a print assembly contact surface 112 and the print assembly 110 can have a print assembly conductor 114 having a known voltage reference. The apparatus 100 can include a blade 120 moveably supported in the apparatus 100. The blade 120 can be configured to be coupled to the print assembly contact surface 112 and the blade 120 can be configured to manipulate material on the print assembly contact surface 112. The apparatus 100 can include a blade conductive layer 130 coupled to the blade 120. The apparatus 100 can include a blade deflection sensor 140 configured to measure a capacitance between the blade conductive layer 130 and the print assembly conductor 114 by providing a signal to the blade conductive layer 130 and configured to receive a signal from the blade conductive layer 130. The received signal can correspond to a capacitance between the blade conductive layer 130 and the print assembly conductor 114. The apparatus 100 can include a controller 150 configured to adjust a blade 120 position relative to the print assembly contact surface 112 based on the measured capacitance to achieve a desired blade load.

For example, the sensor 140 can be used to determine the spacing 160, such as a gap, between the blade 120 and the print assembly contact surface 112. The sensor can be used to determine the spacing 160 by applying a voltage to the blade conductive layer 130 on the underside of the blade 120 that is near the print assembly contact surface 112 and by measuring the capacitance between the blade conductive layer 130 and the print assembly conductor 114 or the change in voltage that can indicate the capacitance.

Figure 2:
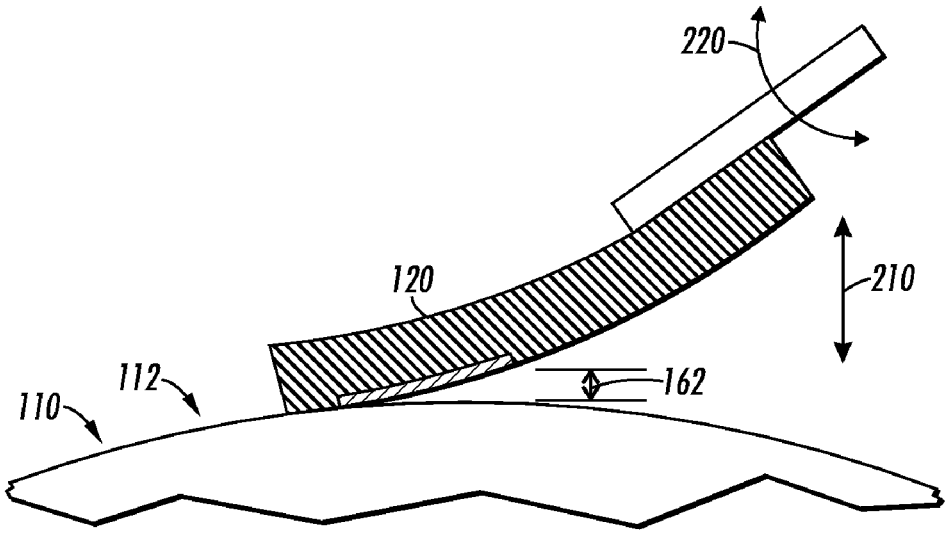
FIG. 2 is an exemplary illustration of an apparatus.

FIG. 2 is an exemplary illustration of the apparatus 100. The blade 120 can be movably supported in the apparatus 100 relative to the print assembly 110. The blade 120 position can be adjusted rotationally 220, linearly 210, or can be adjusted by any other method. The blade 120 can be adjusted to achieve a desired spacing 162 between the blade 120 and the print assembly contact surface 112. For example, a heavy blade load can result in a larger blade 120 deflection, which can result in a smaller spacing 162 between the blade 120 and the print assembly contact surface 112, which can result in a larger capacitance.

As shown in the previous embodiment, a lighter blade load can result in a smaller blade 120 deflection, which can result in a larger spacing 160 between the blade 120 and the print assembly contact surface 112, which can result in a smaller capacitance. The resulting capacitance can be used by the sensor 140 or the controller 150 to determine the blade 120 deflection, spacing, interference, and other properties of the blade 120 relative to the print assembly 100 and the print assembly contact surface 112. The appropriate spacing 162, such as a gap, can be determined based on a desired spacing. The capacitance that corresponds to the desired spacing can be determined experimentally or otherwise so that each apparatus in production can have a sensor that adjusts elements of the apparatus 100 to get the correct capacitance value. The correct capacitance can correspond to the correct spacing, and that spacing, based on the geometry of the apparatus 100, can then dictate the correct interference and load of the blade 120.

The blade load and interference required for good blade operation can be determined from testing. A blade design of blade dimensions and material properties can then be developed to achieve the required blade load and interference that provides good performance. Testing and/or modeling of blade deflection can then determine deflection of the chosen blade design. Measurement of capacitance between the print assembly conductor 114 and the blade conductive layer 130 at the desired deflection can identify a predetermined desired capacitance for good blade operation.

Figure 3:
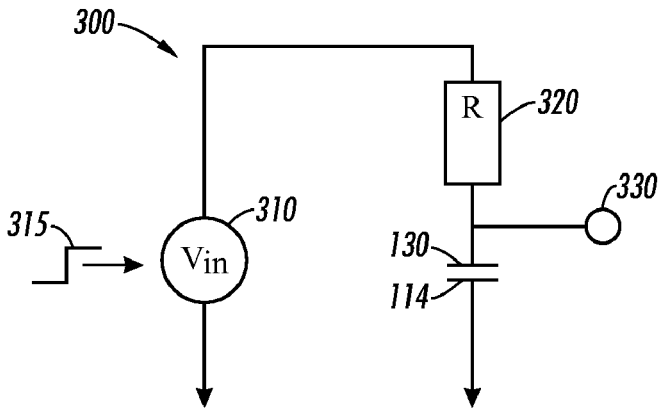
FIG. 3 is an exemplary circuit diagram of a circuit that can be used to sense a capacitance between a blade conductive layer and a print assembly conductor.

FIG. 3 is an exemplary circuit diagram of a circuit 300 that can be used to sense a capacitance between the blade conductive layer 130 and the print assembly conductor 114. The circuit 300 can be an RC circuit that includes a voltage source 310, a resistor 320, an output 330, and a capacitor that is based on the blade conductive layer 130 and the print assembly conductor 114. To test the operation of the apparatus 100, the voltage source 310 applied a step input voltage pulse 315 to the circuit 300. The voltage was measured at the output 330 to compare the output voltage behaviors between a standard blade mounting position and positions where a shim was installed at the blade holder 122 to increase the blade 120 to print assembly contact surface 112 interference. The measured changes in the rise-time of the output voltage waveform across the capacitive sensor 130 and 114 after the input pulse 315 was applied are related to the capacitance changes between the blade conductive layer 130 and the print assembly conductor 114.

Figure 4:
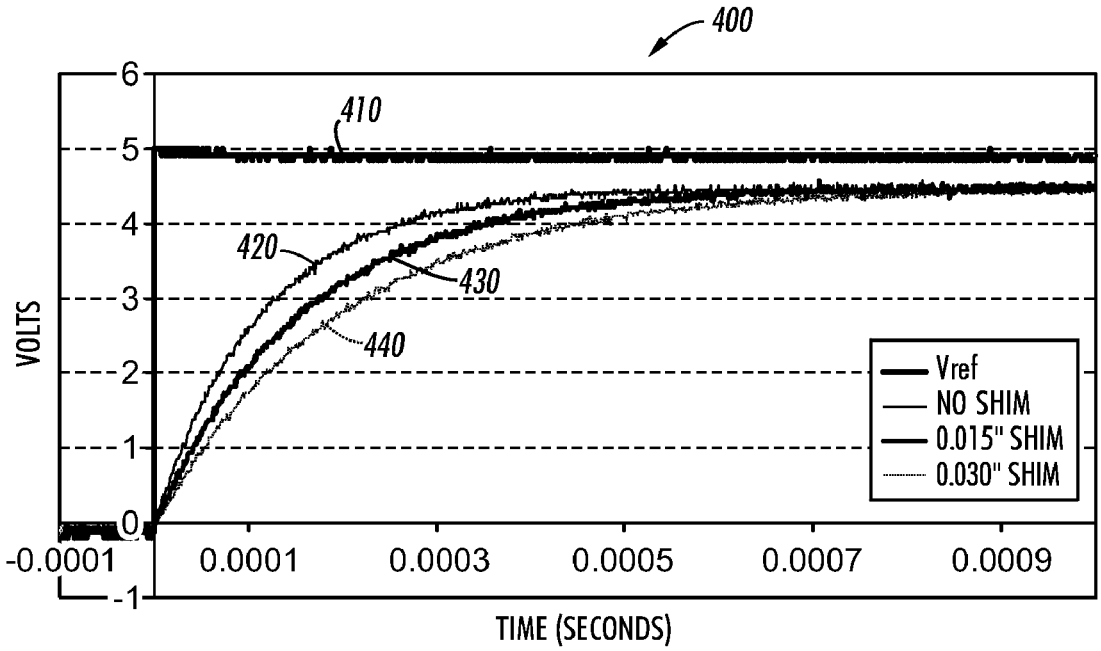
FIG. 4 is an exemplary graph illustrating an output of a circuit.

FIG. 4 is an exemplary graph 400 illustrating an output of the circuit 300 under different blade interference conditions. The graph 400 illustrates the reference voltage 410, samples of the output waveform 420 under a nominal interference condition, samples of the output waveform 430 under an increased interference condition with a 0.015" shim applied to the blade holder 122, and samples of the output waveform 440 under an increased interference condition with a 0.030" shim applied to the blade holder 122.

Figure 5:
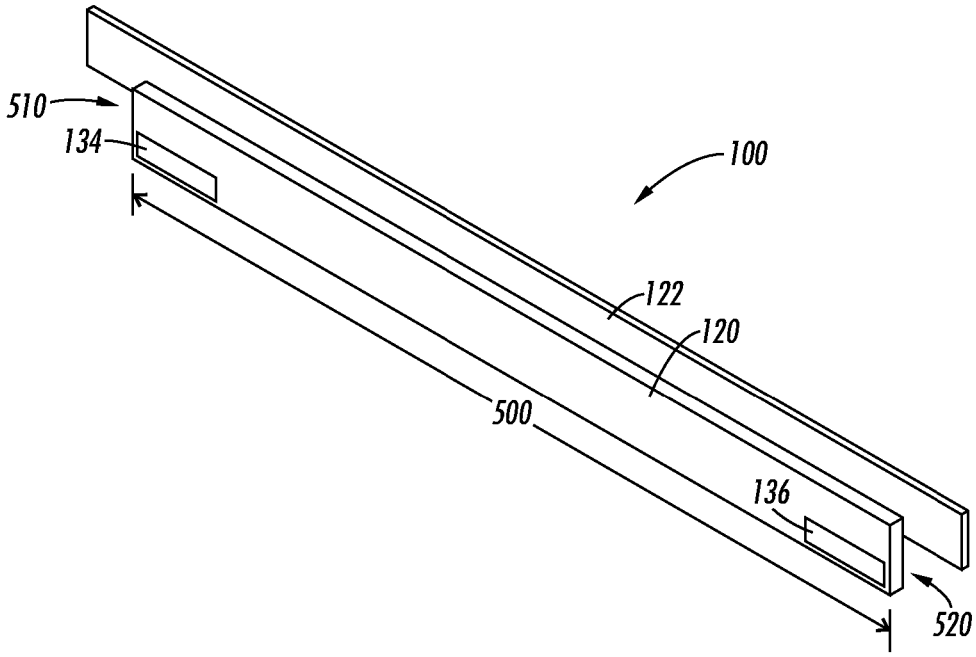
FIG. 5 is an exemplary illustration of an apparatus including a blade mount coupled to a blade having conductive layers.

FIG. 5 is an exemplary illustration of the apparatus 100 including a blade mount 122 coupled to a blade 120 having conductive layers 134 and 136. The blade 120 can have a blade length 500 having a first blade end 510 and having a second blade end 520 at an opposite end of the blade length 500 from the first blade end. The blade conductive layer can include a first blade conductive layer 134 coupled in proximity to the first blade end 510 and a second blade conductive layer 136 coupled in proximity to the second blade end 520. The sensor 140 from the other embodiments can be configured to measure a first capacitance between the first blade conductive layer 134 and the print assembly conductor 114 and configured to measure a second capacitance between the second blade conductive layer 136 and the print assembly conductor 114. For example, the sensor 140 can include two sensors, each configured to measure a capacitance between each blade conductive layer 134 and 136 and the print assembly conductor 114. The controller 150 can then be configured to identify a distance between the first blade end 510 and the print assembly contact surface 112 based on the first measured capacitance and can be configured to identify a distance between the second blade end 520 and the print assembly contact surface 112 based on the second measured capacitance. The controller 150 can be configured to adjust a blade 120 position until the first measured capacitance is substantially the same as the second measured capacitance.

Figure 6:
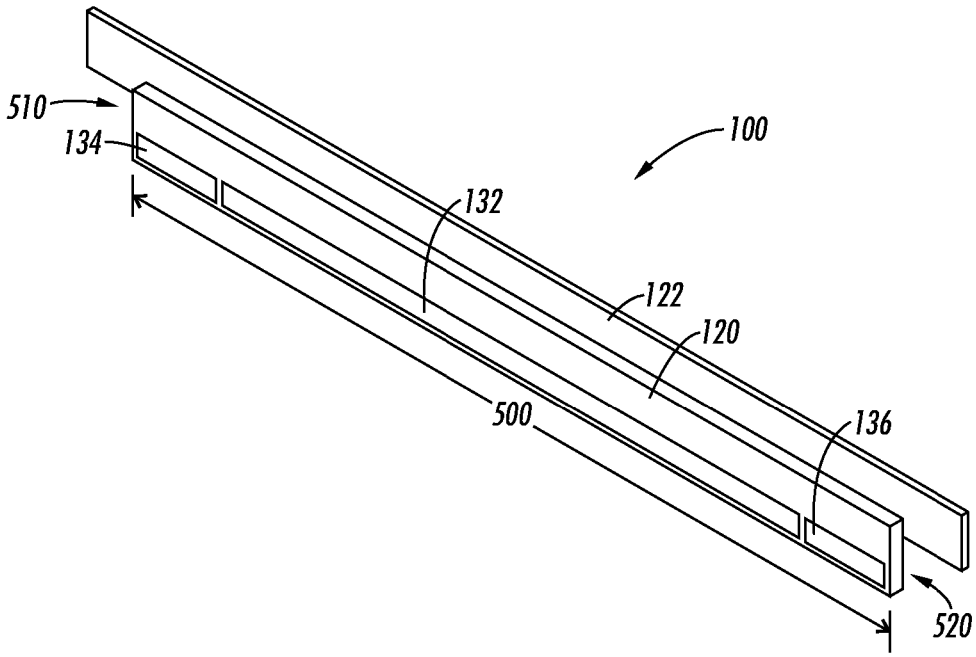
FIG. 6 is an exemplary illustration of an apparatus including a blade mount coupled to a blade having conductive layers.

FIG. 6 is an exemplary illustration of a blade mount 122 coupled to a blade 120 having conductive layers 132, 134, and 136. The blade 120 can have a blade length 500 having a first blade end 510 and having a second blade end 520 at an opposite end of the blade length 500 from the first blade end 510. The blade conductive layer can include a first blade conductive layer 134 coupled in proximity to the first blade end 510 and a second blade conductive layer 136 coupled in proximity to the second blade end 520. The blade conductive layer 136 can include a third blade conductive layer 132 positioned substantially along the length 500 of the blade 120. The sensor 140 can then sense capacitances between the conductive layers 132, 134, and 136 and the print assembly conductor 114 to provide corresponding information to a user or to the controller 150. Thus, identical conductive layers 134 and 136 can be located on the blade ends 510 and 520 to enable alignment of the blade 120 to the print assembly contact surface 112. The conductive layers 134 and 136 on the blade ends 510 and 520 may be used alone or in conjunction with the center conductive layer 132. Alignment accuracy can be obtained by minimizing the difference between the capacitance measured for each conductive layer 134 and 136 on the blade ends 510 and 520. Blade alignment can be more accurate if the conductive layers 134 and 136 are farther apart but not too short. The longer length the central conductive layer 132 can provide greater resolution for setting the capacitance to a predetermined value after the blade 120 has been aligned using the conductive layers 134 and 136 on the blade ends 510 and 520.

Figure 7:
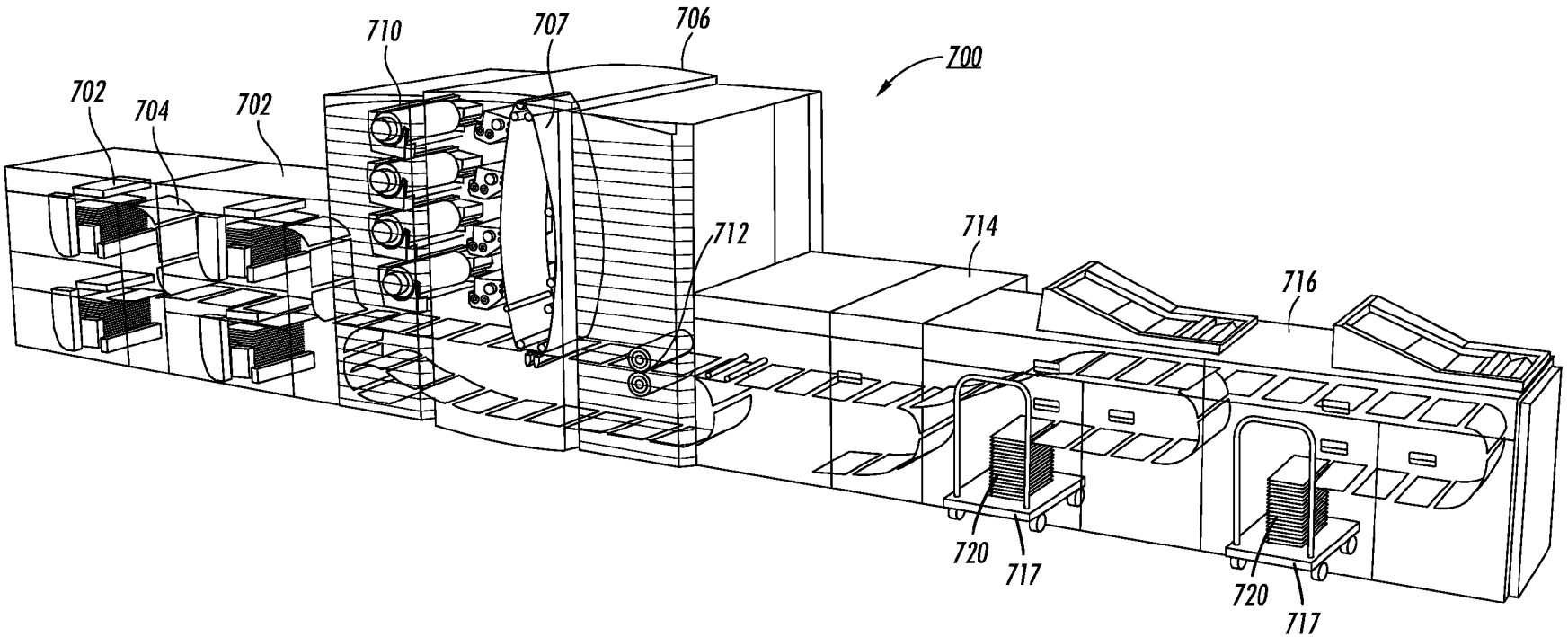
FIG. 7 is an exemplary illustration of a printing apparatus.

FIG. 7 illustrates an exemplary printing apparatus 700, such as the apparatus 100. As used herein, the term "printing apparatus" encompasses any apparatus, such as a digital copier, bookmaking machine, multifunction machine, and other printing devices that perform a print outputting function for any purpose. The printing apparatus 700 can be used to produce prints from various media, such as coated, uncoated, previously marked, or plain paper sheets. The media can have various sizes and weights. In some embodiments, the printing apparatus 700 can have a modular construction. As shown, the printing apparatus 700 can include at least one media feeder module 702, a printer module 706 adjacent the media feeder module 702, an inverter module 714 adjacent the printer module 706, and at least one stacker module 716 adjacent the inverter module 714.

In the printing apparatus 700, the media feeder module 702 can be adapted to feed media 704 having various sizes, widths, lengths, and weights to the printer module 706. In the printer module 706, toner is transferred from an arrangement of developer stations 710 to a charged photoreceptor belt 707 to form toner images on the photoreceptor belt 707. The toner images are transferred to the media 704 fed through a paper path. The media 704 are advanced through a fuser 712 adapted to fuse the toner images on the media 704. The blade 120 with the blade conductive layer 130 from previous embodiments can be used on the photoreceptor belt 707, on the fuser 712, or on any other elements of the printing apparatus 700 that can utilize a blade coupled to a contact surface. The inverter module 714 manipulates the media 704 exiting the printer module 706 by either passing the media 704 through to the stacker module 716, or by inverting and returning the media 704 to the printer module 706. The stacker module 716 loads printed media onto stacker carts 717 to form stacks 720.

Figure 8:
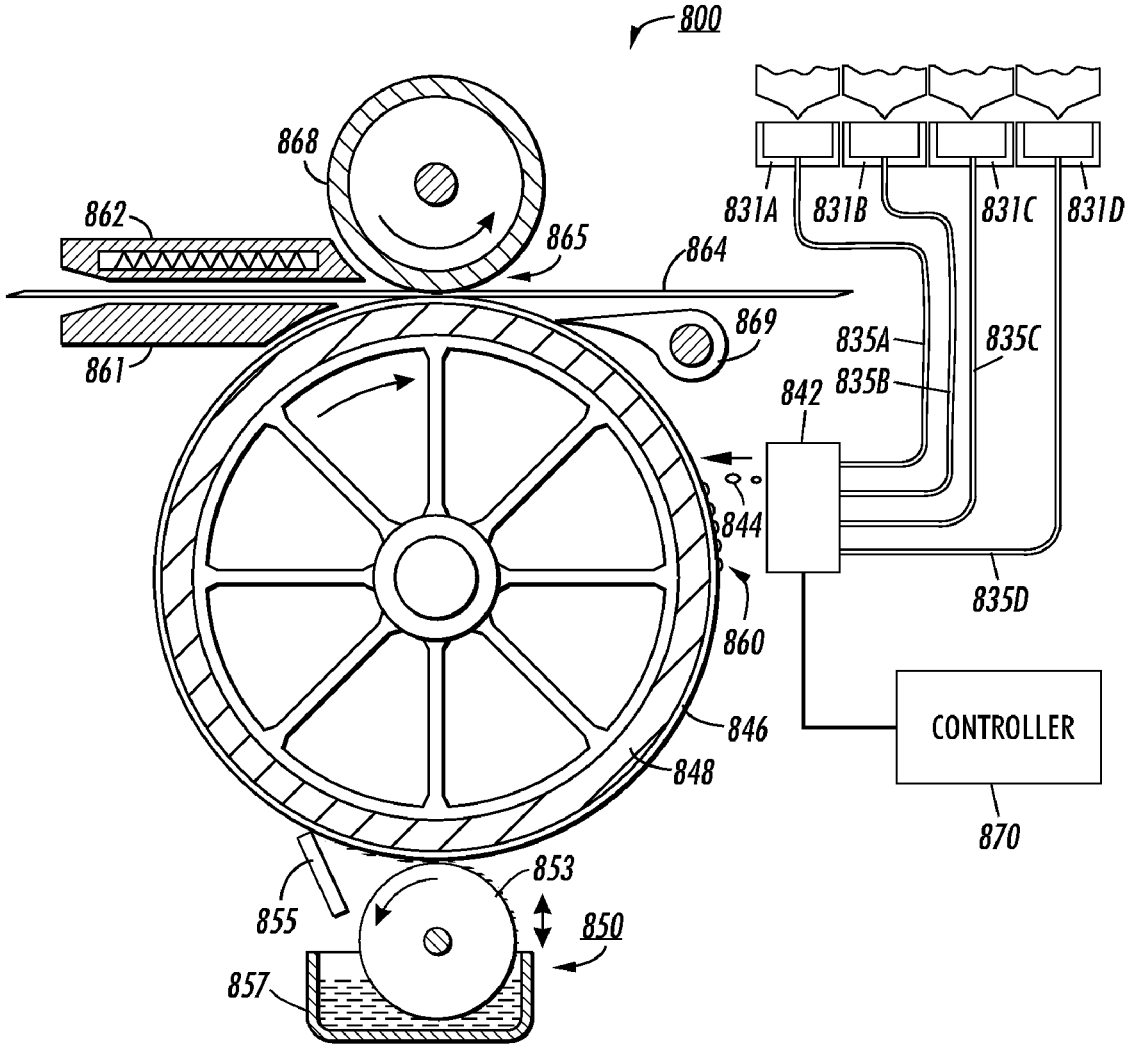
FIG. 8 is an exemplary illustration of an ink jet printing mechanism.

FIG. 8 is a schematic block diagram of an embodiment of an ink jet printing mechanism 800 that can include or be part of the apparatus 100. The printing mechanism 800 can include a printhead 842 that is appropriately supported for stationary or moving utilization to emit drops 844 of ink onto an intermediate transfer surface 846 applied to a supporting surface of a print drum 848. The print drum 848 can include the print assembly 110 and other elements of the apparatus 100. The ink is supplied from the ink reservoirs 831A, 831B, 831C, and 831D of the ink supply system through liquid ink conduits 835A, 835B, 835C, and 835D that connect the ink reservoirs 831A, 831B, 831C, and 831D with the printhead 842. The intermediate transfer surface 846 can be a fluid film, such as a functional oil, that can be applied by contact with an applicator such as a roller 853 of an applicator assembly 850. The roller 853 can also include the print assembly 110 and other elements of the apparatus 100. By way of illustrative example, the applicator assembly 850 can include a metering blade 855, such as the blade 120, and a reservoir 857. The applicator assembly 850 can be configured for selective engagement with the print drum 848. In the illustrative embodiment, the print drum 848 can operate in two rotation cycles where, in a first rotation cycle, the intermediate transfer surface 846 can be applied to the print drum 848 and in a second rotation cycle, the applicator assembly 850 can disengage from the print drum 848 and the printhead 842 can emit drops 844 of ink onto the intermediate transfer surface 846. In another embodiment, the applicator assembly 850 can precede the printhead 842 in an operational direction of the print drum 848 and both the intermediate transfer surface 846 and the ink 844 can be applied to the print drum 848 in one cycle.

The printing mechanism 800 can further include a substrate guide 861 and a media pre-heater 862 that guides a print media substrate 864, such as paper, through a nip 865 formed between opposing actuated surfaces of a roller 868 and the intermediate transfer surface 846 supported by the print drum 848. Stripper fingers or a stripper edge 869 can be movably mounted to assist in removing the print medium substrate 864 from the intermediate transfer surface 846 after an image 860 comprising deposited ink drops is transferred to the print medium substrate 864.

A print controller 870 can be operatively connected to the printhead 842. The print controller 870 can transmit activation signals to the printhead 842 to cause selected individual drop generators of the printhead 842 to eject drops of ink 844. The activation signals can energize individual drop generators of the printhead 842.

Embodiments can provide for a blade deflection sensor for measurement of blade load, alignment and interference. The blade deflection sensor can include a conductive strip adhered to a blade, closely spaced behind the contacting tip. As interference between the blade tip and the contacting surface increases, deflection of the blade increases. This can bring the conductive strip closer to the contacting surface and can increases capacitance between the conductive strip and a conductor corresponding to the contacting surface. The measured capacitance can be used to identify changes in distance between the conductive strip and the contacting surface. The blade critical parameters can be set-up by adjusting the blade position until a predetermined capacitance corresponding to the desired blade load or interference is obtained. The blade can be aligned to the contacting surface by using identical conductive strips mounted on each end of the blade and by adjusting blade end positions until both capacitance measurements are the same.

Capacitance sensors for detecting blade position and deflection can be used to perform cleaning blade alignment and interference set-up on production print units, can provide for lower cost, and can provide better accuracy by performing quicker and easier in situ measurements. Cost and accuracy advantages can also result from converting current high tolerance blade parts to lower cost parts with reduced tolerances that can be quickly set-up using the disclosed capacitive sensor. Furthermore, multiple blade systems that automatically replace worn or damaged blades with new blades can use the blade position/load/alignment capacitance sensor to properly position new blades against the contacting surface. Position actuators on the ends of the blade can be used to move new blades into interference with the contacting surface. Feedback from the capacitive sensor can inform the position actuator controller that the blades are aligned to the contacting surface and at the desired blade load or interference.

Embodiments may preferably be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus useful in printing comprising:

a print assembly rotationally supported in the apparatus, the print assembly having a print assembly contact surface and the print assembly having a print assembly conductor;

a blade configured to be coupled to the print assembly contact surface;

a blade conductive layer coupled to the blade; and a sensor configured to measure a capacitance between the blade conductive layer and the print assembly conductor.

2. The apparatus according to claim 1, further comprising a controller configured to adjust a blade position relative to the print assembly contact surface based on the measured capacitance.

3. The apparatus according to claim 2, wherein the controller is configured to identify a change in a distance between the blade conductive layer and the print assembly contact surface based on the measured capacitance.

4. The apparatus according to claim 2, wherein the controller is configured to adjust a blade position relative to the print assembly contact surface based on the measured capacitance to substantially achieve a desired capacitance between the print assembly conductor and the blade conductive layer, the desired capacitance corresponding to one selected from the group of a desired blade load, an angle between a blade and the print assembly contact surface, and a desired interference between the blade and the print assembly contact surface.

5. The apparatus according to claim 1, wherein the blade conductive layer is positioned along a length of the blade.

6. The apparatus according to claim 1, wherein the blade comprises a blade length having a first blade end and having a second blade end at an opposite end of the blade length from the first blade end, and wherein the blade conductive layer comprises a first blade conductive layer coupled in proximity to the first blade end and a second blade conductive layer coupled in proximity to the second blade end.

7. The apparatus according to claim 6, wherein the sensor is configured to measure a first capacitance between the first blade conductive layer and the print assembly conductor and configured to measure a second capacitance between the second blade conductive layer and the print assembly conductor.

8. The apparatus according to claim 7, further comprising a controller, wherein the controller is configured to identify a distance between the first blade end and the print assembly contact surface based on the first measured capacitance and configured to identify a distance between the second blade end and the print assembly contact surface based on the second measured capacitance.

9. The apparatus according to claim 7, further comprising a controller, wherein the controller is configured to adjust a blade position until the first measured capacitance is substantially the same as the second measured capacitance.

10. The apparatus according to claim 1, wherein the print assembly contact surface comprises one selected from the group of a photoreceptor belt contact surface, a photoreceptor roll contact surface, a development roll contact surface, a fuser contact surface, a release fluid transfer roll contact surface, a release fluid transfer belt contact surface, an ink jet printer print drum contact surface, and an ink jet printer print belt contact surface.

11. The apparatus according to claim 1, wherein the blade conductive layer permeates the blade.

12. The apparatus according to claim 1, wherein the blade conductive layer comprises a conductive strip.

13. The apparatus according to claim 1, wherein the sensor is configured to provide a signal to the blade conductive layer and receive a signal from the blade conductive layer, the received signal corresponding to a capacitance between the blade conductive layer and the print assembly conductor.

14. An apparatus useful in printing comprising:

a print assembly rotationally supported in the apparatus, the print assembly having a print assembly contact surface and the print assembly having a print assembly conductor having a known voltage reference;

a blade moveably supported in the apparatus, the blade configured to be coupled to the print assembly contact surface, the blade configured to manipulate material on the print assembly contact surface;

a blade conductive layer coupled to the blade; and a blade deflection sensor configured to measure a capacitance between the blade conductive layer and the print assembly conductor.

15. The apparatus according to claim 14, wherein the sensor is configured to provide a signal to the blade conductive layer and configured to receive a signal from the blade conductive layer, the received signal corresponding to a capacitance between the blade conductive layer and the print assembly conductor.

16. The apparatus according to claim 14, further comprising a controller configured to adjust a blade position relative to the print assembly contact surface based on the measured capacitance.

17. The apparatus according to claim 16, wherein the controller is configured to adjust a blade position relative to the print assembly contact surface based on the measured capacitance to substantially achieve a desired capacitance between the print assembly conductor and the blade conductive layer.

18. An apparatus useful in printing comprising:

a print assembly rotationally supported in the apparatus, the print assembly having a print assembly contact surface and the print assembly having a print assembly conductor having a known voltage reference;

a blade moveably supported in the apparatus, the blade configured to be coupled to the print assembly contact surface, the blade configured to manipulate material on the print assembly contact surface;

a blade conductive layer coupled to the blade;

a blade deflection sensor configured to measure a capacitance between the blade conductive layer and the print assembly conductor by providing a signal to the blade conductive layer and by receiving a signal from the blade conductive layer, the received signal corresponding to a capacitance between the blade conductive layer and the print assembly conductor; and a controller configured to adjust a blade position relative to the print assembly contact surface based on the measured capacitance to achieve a desired blade load.

19. The apparatus according to claim 18, wherein the blade comprises a blade length having a first blade end and having a second blade end at an opposite end of the blade length from the first blade end, wherein the blade conductive layer comprises a first blade conductive layer coupled in proximity to the first blade end and a second blade conductive layer coupled in proximity to the second blade end, and wherein the sensor is configured to measure a first capacitance between the first blade conductive layer and the print assembly contact surface and configured to measure a second capacitance between the second blade conductive layer and the print assembly contact surface.

20. The apparatus according to claim 19, wherein the blade conductive layer comprises a third blade conductive layer coupled to the blade along the blade length, and wherein the sensor is configured to measure a third capacitance between the third blade conductive layer and the print assembly contact surface.

* * * * *